United States Patent [19]

Bradford

[11] Patent Number: 4,780,017

[45] Date of Patent: Oct. 25, 1988

[54] RESILIENT CONTAINER WITH VENT AND DISPENSING ASSEMBLY

[76] Inventor: Jennifer A. Bradford, 3301 NE. Fifth Ave., #917, Miami, Fla. 33137

[21] Appl. No.: 30,965

[22] Filed: Mar. 27, 1987

[51] Int. Cl.[4] ..... A45D 34/00

[52] U.S. Cl. ..... 401/186; 401/123; 401/124; 401/126; 401/128; 401/129; 401/130

[58] Field of Search ..... 401/186, 123, 124, 126, 401/128, 129, 130, 183, 284

[56] References Cited

U.S. PATENT DOCUMENTS

| | | | |
|---|---|---|---|
| 566,558 | 8/1896 | Bell | 401/284 |
| 1,021,709 | 3/1912 | Snow | 401/129 |
| 1,193,433 | 8/1916 | Searcy | 401/123 |
| 1,712,667 | 5/1929 | Hart | 401/123 X |
| 2,001,086 | 5/1935 | Uillanyi | 401/130 |
| 2,673,362 | 3/1954 | Robinson | 401/186 |
| 2,817,104 | 12/1957 | Hartzell | 401/125 |
| 2,994,897 | 8/1961 | Snable | 401/186 |
| 3,195,544 | 7/1965 | Politzer | 401/183 |

FOREIGN PATENT DOCUMENTS

| | | | |
|---|---|---|---|
| 1461630 | 12/1966 | France | 401/130 |
| 26740 | of 1896 | United Kingdom | 401/129 |
| 309674 | 4/1929 | United Kingdom | 401/129 |

*Primary Examiner*—Steven A. Bratlie
*Attorney, Agent, or Firm*—Charles J. Prescott

[57] ABSTRACT

A container assembly structured to store and selectively dispense and/or apply liquid material contents from a storage chamber in a manner which eliminates waste by enabling substantially the entire quantity of liquid material product to be removed from the storage chamber of the container regardless of viscosity of the product. The container incorporates resilient material side walls which may be disposed into a constricted position thereby forcing product within the storage chamber into contact with an applicator assembly for selective and/or precise dispensing and application of the product.

18 Claims, 2 Drawing Sheets

RESILIENT CONTAINER WITH VENT AND DISPENSING ASSEMBLY

BACKGROUND OF THE INVENTION

1. Field of the Invention

This invention relates to a combined container and dispensing assembly which enables a liquid material product to be dispensed and specifically applied exteriorly of the container in a manner which reduces to a minimum, the amount of liquid material product left within a storage chamber portion of the container. Such dispensing is accomplished by cooperative structure, disposition and manipulation of the container body and applicator assembly and the provision of a venting structure allowing air to pass to and from the interior of the container body.

2. Description of the Prior Art

The container and packaging industry is replete with containers of varying size, shape and structure designed not only to present certain quantities of a given product for retail sale, but also to accomplish dispensing or application of the contents of the container, while maintaining it in a stored, effectively sealed or closed storage chamber or the like. One problem associated with prior art containers is the recognized inability to dispense or otherwise effectively remove all of the product from the interior of the container. This is especially true when a liquid material product is highly viscous such as in certain recognized categories of products, such as make-up, glue or paste, polishes, etc. It is obvious that failure to eliminate all but a minimal amount of product from the container results in waste.

In order to overcome problems of the type set forth above, the prior art has demonstrated certain specifically designed and structured containers and applicators or dispensing structures associated therewith. Such specialty containers and/or dispensing structures have resulted in what may generally be considered to be overly complex devices which not only raise the price of the container/dispenser, but also frequently results in a short operable life of less than totally reliable performance of the container/dispenser before the entire contained product has been dispensed.

Certain existing United States patents are generally representative of attempts to overcome many or all of the problems generally set forth above, and well recognized in the industry. Such U.S. Pat. Nos. include Friedberg, 2,112,620; Calhoun, 2,610,732; Pepin, 2,644,613; Dritz, 2,869,162; Otto et al., 2,964,445; Lerner, 3,185,291; Prior, 3,341,884; Chennell, 3,485,563; Bennet, 4,189,245; and Buckley, 4,219,283. While operative for their intended function, certain disadvantages generally do exist in many of the structures disclosed in the above set forth patents. Accordingly, there is a recognized need in the container or packaging industry for a combination container and/or dispensing assembly capable of being used to both contain and selectively apply or dispense a wide variety of preferably liquid material products which may vary significantly in the degree of viscosity demonstrated by such products.

SUMMARY OF THE INVENTION

The present invention is directed towards a container designed to store primarily a liquid material product in the interior thereof and also wherein the container of the subject invention is used in combination with a dispensing assembly incorporating a specific applicator means disposed, dimensioned and structured for exposure to and contact with, the product upon a selected and preferred manipulation of the container body. It is to be emphasized that the structure of the subject invention is capable of being utilized to contain and dispense numerous types of products. The term "liquid material," as used herein, is meant to incorporate a variety of products varying greatly in consistency. For example, the consistency or viscosity of the material product contained and dispensed through utilization of the subject invention may vary between a product having the consistency of water or, alternately, a product having a consistency of glue, as well as all products having varying consistencies or viscosities between these two extremes. The versatility of the structure of the subject invention, to be described in greater detail hereinafter, may remain substantially the same with possibly minor variations regardless of the type product for which the subject container/dispenser is intended for use. More structural variances may be included in an applicator means associated with the subject container dependent upon the particular use for which the liquid material product contained is intended.

The assembly of the present invention comprises a container body preferably having an elongated configuration and including a hollow interior portion extending along a majority of its length. Such hollow interior portion defines, for the most part, a storage chamber in which liquid material product is stored. A closed end of the container body is disposed immediately adjacent the storage chamber and in effect, defines a certain longitudinal boundary thereof. The container body further includes an open end oppositely disposed relative to the closed end.

The container body also includes a throat portion having a somewhat elongated configuration and defining a channel of fluid communication between the interior of the storage chamber and the aforementioned open end. A closure means, preferably in the form of a removably secured cap structure, is disposed in covering relation to the open end and is otherwise structured to maintain the liquid material product within the storage chamber in a condition ready for use even after periods of prolonged storage. It is recognized that in certain instances proper sealing facilities should be incorporated in the structure of the closure means in order to prevent excessive exposure of the contained product to atmosphere. Along these lines it is also recognized that dimensional requirements of certain venting means, to be described in greater detail hereinafter, must also be adhered to in order to prevent both inadvertent leakage of the product from the container, such as when it is in an inverted orientation, and also to prevent excessive drying of the product.

An applicator means is integrally, or at least in part otherwise attached, to the closure means for movement therewith. Removal of the cap from its covering relation to the open end of the container body also serves to remove the applicator means from a preferred location intermediate opposite ends of the throat portion. The applicator means comprises an elongated stem having any one of a plurality of applicator elements fixed to the distal end thereof. An important feature of the present invention is the dimensioning of the applicator stem such that the applicator element is in fact positioned in communicating relation to the liquid material product, while at the same time being disposed, at least in part, within the interior of the throat portion and in cooperative engagement with passage means defining a portion of the vent means.

The vent means includes a venting channel or aperture formed preferably in a closure cap of the closure means and being dimensioned so as to allow escape of a forced air flow from the interior of the container body. In addition, the vent means includes the aforementioned passage means comprising at least one, but preferably a plurality of elongated passages integrally formed in an inner surface of the throat portion and extending along the length of the throat portion. The disposition and dimension of the one passage, or plurality of passages, defining the passage means, enable the forced flow of air to pass from the storage chamber, beyond the applicator element, towards the open end of the container body and eventually out through the vent channel formed in the closure means. However, the transverse dimension of the passage means is such as to restrict and thereby effectively prevent liquid flow therealong, while enabling the aforementioned forced air flow.

An important feature of the present invention, which enables the liquid material product to be dispensed in an effective and efficient manner, especially in terms of waste, is the provision of a resilient material side wall structure of the container body disposed in surrounding relation to the inner storage chamber. More specifically, the resilient side wall structure is normally disposed or "biased" in an outer expanded position. Such position defines the normal boundary of the storage chamber and is the position of the container body defining the maximum capacity of the storage chamber. The resiliency of the material from which the side wall structure is formed enables a forced disposition of the side wall structure into a constricted orientation. Such may be readily accomplished by the fingers of the user gripping substantially opposite external surfaces of the side wall structure and pushing such opposite portions together into the aforementioned constricted orientation or position. This effectively reduces the volume of the storage chamber, thereby forcing the liquid material product from the storage chamber towards the throat portion and eventually into direct engaging contact with an exposed face of the applicator element.

The reduction of the volume of the storage chamber forces both liquid material product and any air contained therein from the storage chamber up toward the throat portion as set forth above. Air requiring venting passes through the restricted passage of the passage means which may include the one passage, or dependent upon the particular embodiment of the present invention, a plurality of such passages. Cooperative dimensioning and disposition between the passage means and the applicator element maintains a path of fluid flow along the passage means which is transversely dimensioned to allow air flow but restrict liquid flow therealong.

Due to the resiliency of the side wall structure, it will normally assume the aforementioned expanded position upon release of the force applied thereto by the fingers of the user. This will have a "negative pressure" effect on the interior serving to draw in air from the exterior of the container body through vent means of the closure cap down through the passage means and eventually into the storage chamber. Assumption of the side wall structure in the expanded position further serves to effectively withdraw or displace the liquid material product from direct contact or engagement with the applicator element since the storage chamber has a greatly increased capacity or volume when the side wall structure is in the aforementioned expanded position.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying daawings in which.

Like reference numerals refer to like parts throughout the several views of the drawings.

DESCRIPTION OF THE PREFERRED EMBODIMENT

Figure 1:
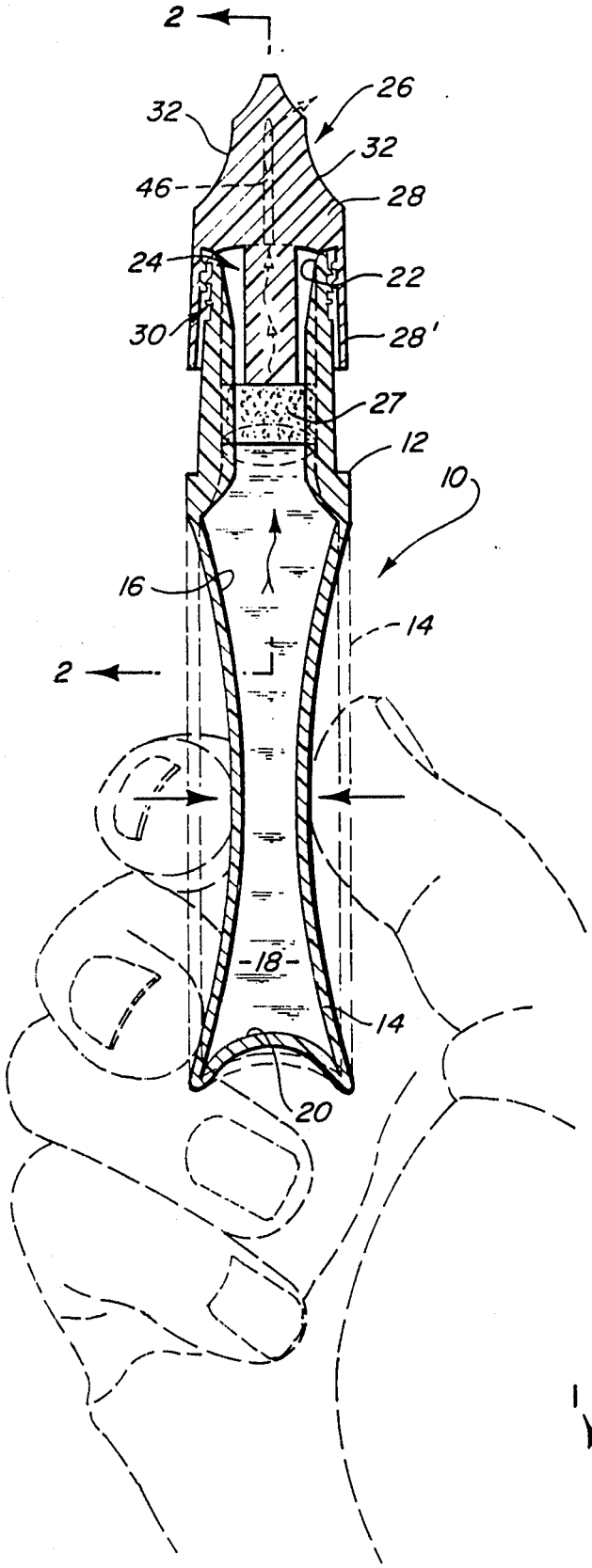
FIG. 1 is a longitudinal sectional view of the assembly of the present invention, wherein a side wall structure of the container body is shown in a constricted position and a normal or expanded position of the side wall structure is represented in phantom lines.

The container and dispenser assembly of the present invention is generally indicated as 10, and comprises a container body 12 preferably formed of a plastic material and specifically including a side wall structure 14 formed of a resilient material so as to be capable of selective movement between a constricted position, as represented in solid lines in FIG. 1, and an expanded position as represented in phantom lines in FIG. 1. The container body 12 has an elongated configuration and includes a hollow interior 16 defining what may be referred to as a storage chamber for liquid material product 18 therein. The container body 12 includes a closed end 20 disposed immediately adjacent to, and at least partially defining, the boundaries of the storage chamber 16. An open end 22 is formed at an opposite end of the container body 12 relative to the closed end 20 and serves as an access means for an applicator means 24 and for the initial filling of the storage chamber 16 with the liquid material product 18.

Figure 2:
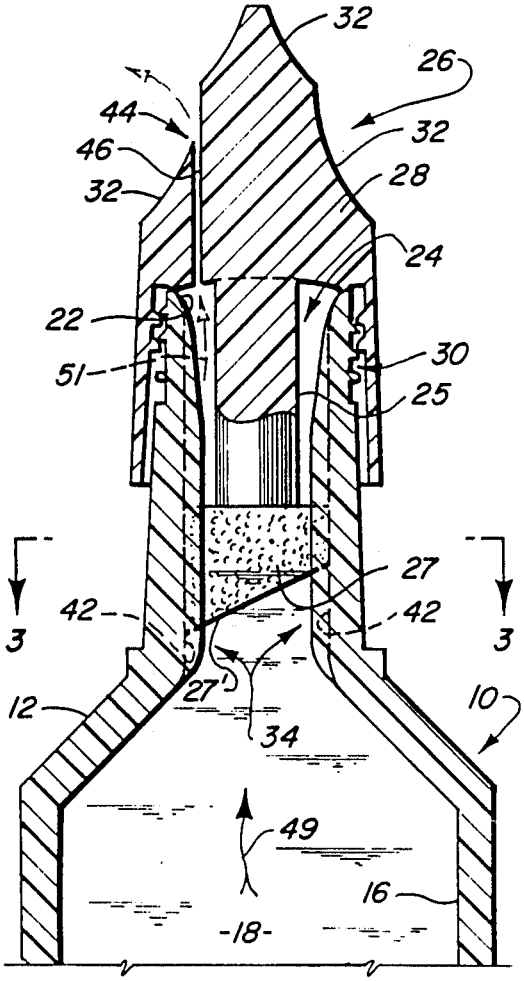
FIG. 2 is a sectional view in partial cut-away along line 2—2 of FIG. 1.

The assembly 10 further comprises a closure means generally indicated as 26, preferably including a closure cap 28 removably disposed in covering relation to the open end 22. Such removable connection or mounting of the closure cap 28 relative to the open end 22 occurs, in the embodiments of FIGS. 1 and 2, by means of a threaded interconnection between the inner surface of the depending flange 28' of the closure cap 28 and the outer surface of the container body 12 adjacent to the open end 22, as best shown in FIGS. 1 and 2. Such threaded interconnection, while generally represented as 30 represents one structural embodiment of a means for securing the closure cap 28 to the container body 12 in covering relation to the open end 22. It should be emphasized that such a threaded connection 30 is not the only structural configuration which would allow such removable, covering interconnection.

Other structural features of the closure cap 28 include specifically formed indentations or depressions 32 on the exterior surface of the closure cap 28. Such indentations are disposed and dimensioned to facilitate gripping of the closure cap 28 by the fingers of the user.

An important structural feature of the present invention is the existence of a throat portion generally indicated in FIG. 2 as 34. Such throat portion has an elongated configuration, and extends in interconnecting, fluid communicating relation between the open end 22 and the storage chamber 16. Further, in one preferred embodiment of the present invention, the transverse dimension of the throat portion 34 is somewhat less than the transverse dimension of the storage chamber 16.

In addition, the applicator means 24 comprises an elongated stem 25, having one end integrally or otherwise fixedly secured to the closure cap 28 so as to depend therefrom and allow placement of an applicator element 27 within the throat portion 34. More specifically, when the closure cap 28 is in covering relation to the open end 22, as shown in FIGS. 1 and 2, the applicator stem 25 is specifically dimensioned to accomplish disposition of the applicator element 27 at a locale within throat portion 34, preferably intermediate opposite ends thereof. This disposition allows fluid communication with the liquid material contents 18 of the storage chamber 16, and eventual direct receiving contact therewith. Such contact occurs when the side wall structure 14 is forced into the constricted position, as represented in solid lines in FIG. 1. Further, the relative elongated dimensions of the throat portion 34 and the stem 25 are such that the stem 25 has a relatively short longitudinal dimension. It is recognized that the term "short" is a relative term, but for purposes of the present invention, it is meant to include a reasonable longitudinal dimension sufficient to provide adequate and preferred control over precise application of the liquid material product 18 once it is received on and carried with the applicator element 27, and more specifically, an exposed applicator face 27' thereof. Such a "short" longitudinal dimension of the applicator stem 25 enables precise control of application of the product 18 such as when a user is applying make-up, including lipstick, eye blush, etc.

Figure 3:
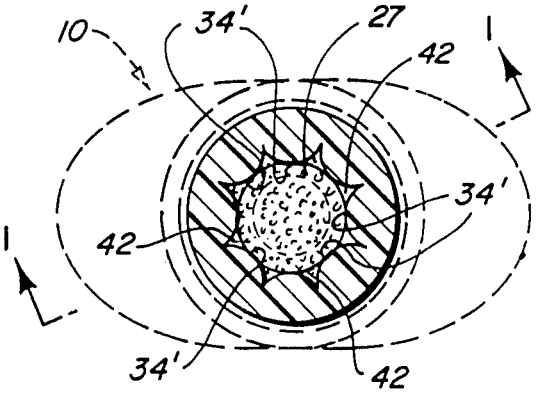
FIG. 3 is a transverse cross-sectional view along line 3—3 of FIG. 2, wherein the exterior configuration of the container body is represented in phantom lines.

Other dimensional characteristics of the applicator element 27 are best demonstrated in FIG. 3. The transverse dimension of the applicator element 27 is such as to engage the inner surface of the throat portion 34 as at 34'. However, both the transverse dimension of the applicator element 27 and the material from which it is formed prevent passage of the periphery thereof into any one of preferably a plurality of passages 42 integrally formed to extend into the inner surface 34' of the throat portion 34. The plurality of passages defines what may be referred to as a passage means which enable forced air flow beyond the applicator element 27 specifically when the side wall structure 14 is forced into the constricted position as shown in solid lines in FIG. 1. As set forth above, such constricted position of the side wall structure 14 reduces the capacity and volume of the storage chamber 16 forcing the liquid material product 18 up into throat portion 34. Such forced travel of the liquid product 18 causes the product to be received on the exposed face 27' (see FIG. 2) of the applicator element 27. Concurrently, any air normally existing within the storage chamber 16, when the side wall structure 14 is in its expanded position, will be forced outwardly therefrom upon positioning of the side wall structure 14 into the constructed positioned. The air flow through one or a plurality of passages 42 (see FIG. 3) and out through a vent means, generally indicated as 44, in the closure cap 28. The vent means, specifically regarding the structure of the closure means 26, may be in the form of a vent channel 46, as best shown in FIG. 2.

Therefore, it should be readily apparent that both the plurality of passages 42 defining the passage means and the vent channel 46 can be considered part of a vent means which serves to allow external venting of air within the storage chamber 16, as well as other portions of the container body 12, to atmosphere. This of course occurs, as emphasized above, when the wall structure 14 is forced into the constricted position shown in FIG. 1. Upon release of the wall structure 14 from its constricted position, and the assumption of the wall structure into the normal, expanded position, air will be drawn back through the vent means including the vent channel 46 and one or more passages 42 due to the expanded volume of the storage chamber 16. For purposes of clarity, travel of the liquid product 18 into the entrance to the throat portion 34 and eventual receiving engagement with the applicator face 27' of applicator 27 is indicated by solid directional arrow 49. Similarly, travel of air vented to atmosphere, as described above, is represented by the phantom arrows (see FIGS. 2 and 4 through 7).

Other structural features of the present invention include a variety of embodiments of the applicator element 27. With regard to FIGS. 1, 2 and 3, the applicator element 27 comprises a porous, generally sponge-like material having an angularly oriented applicator face 27'. Such applicator element 27 and its configuration is best suited for what may be referred to as precision application of the liquid product 18 such as possibly suited for the precise application of make-up, such as lipstick, eye make-up, etc.

Figure 4:
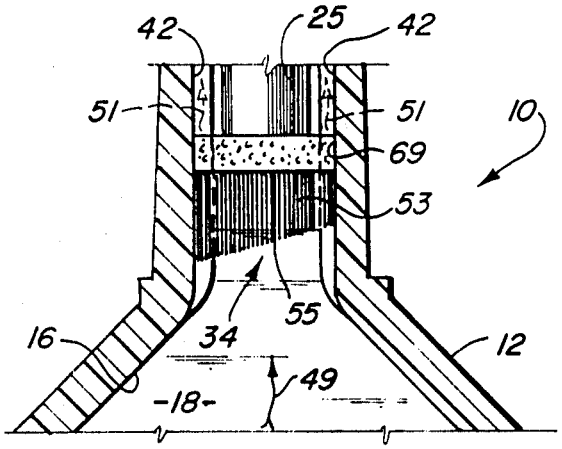
FIG. 4 is a sectional view in partial cut-away of another embodiment of an applicator element of the present invention.

FIG. 4 discloses an applicator element 53 having an angularly oriented applicator face 55 wherein the applicator element 53 is defined by a plurality of spaced apart, substantially linear and somewhat course material bristles. Such an applicator element is suitable for fingernail polish or like liquid material 18.

Figure 5:
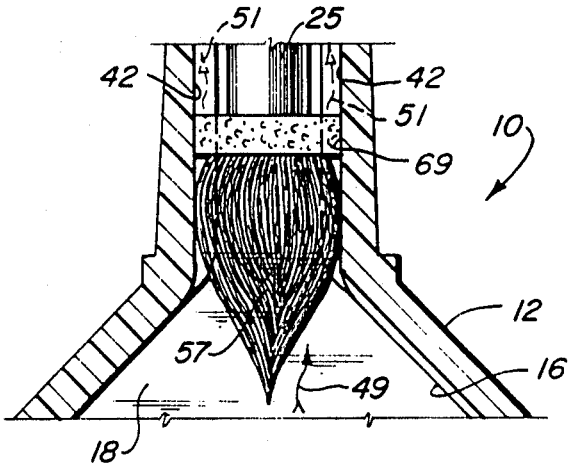
FIG. 5 is a sectional view in partial cut-away of yet another embodiment of the applicator element of the present invention.

FIG. 5 shows applicator element 57 in the form of a brush having relatively soft curvilinearly oriented bristles disposed in inter-engagement with one another. Such an applicator element 57 may be best suited for the ample application of the liquid material 18, such as when applying blush type make-up.

Figure 6:
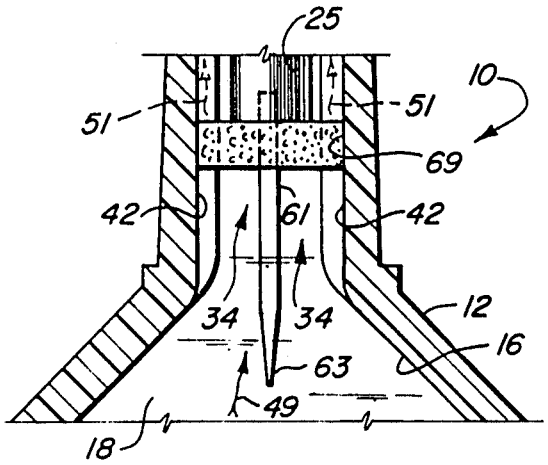
FIG. 6 is a sectional view in partial cut-away of yet another embodiment of the applicator element of the present invention.
Figure 7:
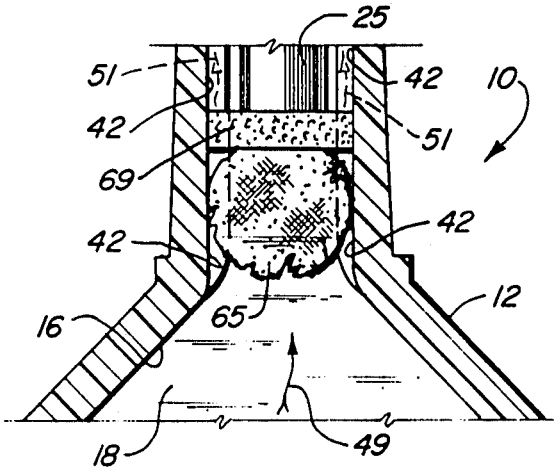
FIG. 7 is a sectional view in partial cut-away of yet another embodiment of the applicator element of the present invention.

FIG. 6 shows an applicator element in the form of an elongated rod 61 having a somewhat pointed distal end 63. Such an applicator may be best suited for applying lotion or applicable liquid product to relatively closed areas, such as the junction of the fingernail and fingers or for cuticle care FIG. 7 shows applicator element 65 in the form of a generally spherically configured dauber formed from an absorbent material wherein such an applicator element 65 may be best suited for the application of shoe polish or a wide variety of other liquid products 18.

In the embodiment of FIGS. 4 through 7, each of the applicator elements are secured to and depend from an applicable material shield or platform 69 serving to interconnect and at least partially segregate the stem 25 from the respective applicator elements.

It is therefore to be understood that the following claims are intended to cover all of the generic and specific features of the invention herein described and all statements of the scope of the invention, which as a matter of language, might be said to fall therebetween.

Now that the invention has been described, what is claimed is:

1. A container and dispenser assembly designed for the storage and selective application of a liquid material product, said assembly comprising:

a. a container body having an elongated configuration and a hollow interior portion extending along a majority of the length thereof, said hollow interior portion defining a storage chamber, b. said container body comprising a closed end disposed adjacent said storage chamber and an oppositely disposed open end positioned in spaced relation to said closed end, c. said container body further comprising a throat portion having an elongated configuration and extending in interconnecting, communicating relation between said open end and said storage chamber, d. closure means removably securable to said container body in covering relation to said open for selectively closing said storage chamber, e. applicator means for dispensing the liquid material content of said storage chamber and connected to said closure means and extending outwardly therefrom into said throat portion, f. said applicator means comprising an applicator element positionable within said throat portion in inwardly spaced relation from said open end and in communicating relation to said storage chamber and including a transverse dimension sufficient to maintain continuous engagement with an inner surface of said throat portion about a periphery of said applicator element, g. vent means for venting air from within said container body to the exterior thereof, said vent means comprising passage means for venting air from said storage chamber to said open end in bypassing relation to said applicator element, h. said passage means including at least one passage integrally formed in said inner surface of said throat portion and disposed along the length thereof, and extending inwardly into said inner surface and substantially out of contact with said applicator element, i. said one passage being cooperatively disposed relative to said applicator element and its engagement with said inner surface of said throat portion and comprising a transverse dimension along its length to facilitate air flow and restrict liquid flow from said storage chamber toward said open end, j. said container body including a resilient material side wall structure disposed in surrounding relation to said storage chamber and selectively positionable between an expanded position and a constricted position, and k. said constricted position forcing liquid material within said storage chamber into engagement with said applicator element and air within said storage chamber along said passage means beyond said applicator element, through said vent means to atmosphere.

2. An assembly as in claim 1 wherein said side wall structure is normally disposed into said expanded position and forcibly disposable out of said expanded position and into said constricted position.

3. An assembly as in claim 2 wherein said container body and throat portion are of an integral one-piece construction.

4. An assembly as in claim 1 wherein said closure means comprises a cap structure removably securable to said container body in covering relation to said open end, said applicator means secured to said cap structure and removable from said container body therewith.

5. An assembly as in claim 4 wherein said applicator means comprises an elongated stem secured at one end to said cap structure and connected to said applicator element at an opposite end thereof.

6. An assembly as in claim 5 wherein said stem comprises a sufficient length to dispose said applicator element intermediate opposite ends of said throat portion in communicating relation to the liquid material product within said storage container.

7. An assembly as in claim 1 wherein said applicator element comprises a substantially porous material having an exposed applicator face disposed in direct receiving relation to liquid material product within said storage chamber when said side wall structure is in said constricted position.

8. An assembly as in claim 7 wherein said exposed applicator face is angularly oriented relative to a central longitudinal axis of said throat portion when said closure means is in covering relation to said open end.

9. An assembly as in claim 1 wherein said applicator element comprises a brush structure defined by a plurality of relatively course, elongated substantially linearly oriented bristles collectively defining an exposed applicator face at a common end thereof.

10. An assembly as in claim 9 wherein said exposed applicator face is angularly oriented relative to a central longitudinal axis of said throat portion when said closure means is in covering relation to said open end.

11. An assembly as in claim 1 wherein said applicator element comprises an elongated, semi-rigid material rod having a substantially pointed distal end.

12. An assembly as in claim 1 wherein said applicator element comprises a brush structure defined by a plurality of relatively soft curvilinearly oriented bristles disposed in engaging relation to one another along a majority of their length.

13. An assembly as in claim 1 wherein said applicator element comprises an absorbent material dauber having a substantially spherical configuration.

14. An assembly as in claim 1 wherein said passage means comprises a plurality of passages each integrally formed in an inner surface of said throat portion and having an elongated configuration extending along the length of said throat portion beyond opposite sides of said applicator element disposed within said throat portion when said closure means is in covering relation to said open end.

15. An assembly as in claim 14 wherein each of said passages extend inwardly into said inner surface of said throat portion and out of contact with said applicator element, whereby air passes along said passages beyond said applicator element when said side wall structure is disposed into said constricted position.

16. An assembly as in claim 15 wherein said plurality of passages are equally spaced from one another and collectively surround said applicator element.

17. An assembly as in claim 16 wherein said plurality of passages are cooperatively structured and disposed relative to said inner surface of said throat portion to collectively define a substantially fluted transverse cross-sectional configuration of said throat portion.

18. An assembly as in claim 14 wherein each of said passages comprises a transverse dimension along a majority of its length sufficient to allow air flow and restrict liquid flow therealong from said storage container toward said open end.

* * * * *

UNITED STATES PATENT AND TRADEMARK OFFICE

CERTIFICATE OF CORRECTION

PATENT NO. : 4,780,017

DATED : October 25, 1988

INVENTOR(S) : Jennifer A. Bradford

It is certified that error appears in the above-identified patent and that said Letters Patent is hereby corrected as shown below:

In Column 7, Line 33, after "open", insert -- end --.

In Column 8, Line 29, after "material", insert -- pad --.

Signed and Sealed this

Twenty-eighth Day of February, 1989

*Attest:*

DONALD J. QUIGG

*Attesting Officer*

*Commissioner of Patents and Trademarks*